US009693413B2

(12) United States Patent
Lys

(10) Patent No.: US 9,693,413 B2
(45) Date of Patent: Jun. 27, 2017

(54) APPARATUS FOR CONTROLLING SERIES-CONNECTED LIGHT EMITTING DIODES

(75) Inventor: Ihor Lys, Briarcliff Manor, NY (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 959 days.

(21) Appl. No.: 12/473,739

(22) Filed: May 28, 2009

(65) Prior Publication Data

US 2010/0231133 A1 Sep. 16, 2010

Related U.S. Application Data

(63) Continuation-in-part of application No. 11/938,051, filed on Nov. 9, 2007, now Pat. No. 7,781,979.

(60) Provisional application No. 60/956,309, filed on Aug. 16, 2007, provisional application No. 60/865,353, filed on Nov. 10, 2006.

(51) Int. Cl.
*H05B 37/02* (2006.01)
*H05B 33/08* (2006.01)

(52) U.S. Cl.
CPC ..... *H05B 33/0857* (2013.01); *H05B 33/083* (2013.01)

(58) Field of Classification Search
CPC .... H05B 37/02; H05B 33/08; H05B 33/0812; H05B 33/0815; H05B 33/0821; H05B 33/0845; H05B 35/00
USPC ..... 315/209 R–211 R, 214–217, 225, 291, 315/307, 312–315, 320, 360–362
See application file for complete search history.

(56) References Cited

U.S. PATENT DOCUMENTS

| | | | | |
|---|---|---|---|---|
| 4,017,847 | A | 4/1977 | Burford et al. | |
| 5,457,450 | A | 10/1995 | Deese et al. | |
| 6,016,038 | A | 1/2000 | Mueller et al. | |
| 6,137,816 | A * | 10/2000 | Kinbara | 372/29.012 |
| 6,211,626 | B1 | 4/2001 | Lye et al. | |
| 6,777,891 | B2 | 8/2004 | Lys et al. | |
| 7,710,050 | B2 * | 5/2010 | Preston et al. | 315/312 |
| 2004/0160199 | A1 | 8/2004 | Morgan et al. | |
| 2006/0244396 | A1 | 11/2006 | Bucur | |
| 2008/0094004 | A1 * | 4/2008 | Ackermann | H01L 25/167 315/294 |

FOREIGN PATENT DOCUMENTS

| | | | |
|---|---|---|---|
| EP | 1589519 | A2 | 10/2005 |
| JP | 2005100799 | A | 4/2005 |
| JP | 2006123562 | A | 5/2006 |
| JP | 2006147933 | A | 6/2006 |
| WO | 9821918 | A1 | 5/1998 |

(Continued)

*Primary Examiner* — Jimmy Vu

(57) ABSTRACT

An apparatus for controlling an LED-based lighting system includes a comparison circuit configured to compare at least one signal representative of a supply voltage with at least one other signal representative of a series voltage drop over at least some of a plurality of LEDs connected electrically in series. The apparatus includes a controller, connected to the comparison circuit; and a power section connected to the controller. The power section is configured to operate at least one switch such that the number of LEDs operated in series may be changed in response to the comparison circuit.

6 Claims, 3 Drawing Sheets

(56) References Cited

FOREIGN PATENT DOCUMENTS

| | | | |
|---|---|---|---|
| WO | 9821919 | A1 | 5/1998 |
| WO | 2006110340 | A1 | 10/2006 |

* cited by examiner

APPARATUS FOR CONTROLLING SERIES-CONNECTED LIGHT EMITTING DIODES

CROSS-REFERENCE TO RELATED APPLICATIONS

The present application is a continuation-in-part of commonly-owned U.S. patent application Ser. No. 11/938,051, entitled "Methods and Apparatus for Controlling Series-Connected LEDS" to Ihor A. Lys, and filed on Nov. 7, 2007. Priority is claimed under 35 U.S.C. §120 from this patent application, and the entire disclosure of this patent application is specifically incorporated herein by reference.

TECHNICAL FIELD

The present invention is directed generally to digital lighting technologies. More particularly, various inventive methods and apparatuses disclosed herein relate to control of series-connected light emitting diodes (LEDs).

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

(LEDs) are semiconductor-based light sources often employed in low-power instrumentation and appliance applications for indication purposes. LEDs conventionally are available in a variety of colors (e.g., red, green, yellow, blue, white), based on the types of materials used in their fabrication. This color variety of LEDs recently has been exploited to create novel LED-based light sources having sufficient light output for new space-illumination applications. For example, as discussed in U.S. Pat. No. 6,016,038, multiple differently colored LEDs may be combined in a lighting fixture, wherein the intensity of the LEDs of each different color is independently varied to produce a number of different hues. In one example of such an apparatus, red, green, and blue LEDs are used in combination to produce literally hundreds of different hues from a single lighting fixture. Additionally, the relative intensities of the red, green, and blue LEDs may be computer controlled, thereby providing a programmable multi-color light source. Such LED-based light sources have been employed in a variety of lighting applications in which variable color lighting effects are desired.

For example, U.S. Pat. No. 6,777,891 (the "'891 patent"), incorporated herein by reference, contemplates arranging a plurality of LED-based lighting units as a computer-controllable "light string," wherein each lighting unit constitutes an individually-controllable "node" of the light string.

Applications suitable for such light strings include decorative and entertainment-oriented lighting applications (e.g., Christmas tree lights, display lights, theme park lighting, video and other game arcade lighting, etc.). Via computer control, one or more such light strings provide a variety of complex temporal and color-changing lighting effects. In many implementations, lighting data is communicated to one or more nodes of a given light string in a serial manner, according to a variety of different data transmission and processing schemes, while power is provided in parallel to respective lighting units of the string (e.g., from a rectified high voltage source, in some instances with a substantial ripple voltage).

The operating voltage required by each lighting unit (as well as the string, due to the parallel power interconnection of lighting units) typically is related to the forward voltage of the LEDs in each lighting unit (e.g., from approximately 2 to 3.5 Volts depending on the type/color of LED), how many LEDs are employed for each "color channel" of the lighting unit and how they are interconnected, and how respective color channels are organized to receive power from a power source. For example, the operating voltage for a lighting unit having a parallel arrangement of respective color channels to receive power, each channel including one LED having a forward voltage on the order of 3 Volts and corresponding circuitry to provide current to the channel, may be on the order of 4 to 5 Volts, which is applied in parallel to all channels to accommodate the one LED and current circuitry in each channel. Accordingly, in many applications, some type of voltage conversion device is desirable in order to provide a generally lower operating voltage to one or more LED-based lighting units from more commonly available higher power supply voltages (e.g., 12 VDC, 15 VDC, 24 VDC, a rectified line voltage, etc.).

One impediment to widespread adoption of low-voltage LEDs and low-voltage LED-based lighting units as light sources in applications in which generally higher power supply voltages are readily available is the need to convert energy from one voltage to another, which, in many instances, results in conversion inefficiency and wasted energy. Furthermore, energy conversion typically involves power management components of a type and size that generally impede integration. Conventionally, LEDs are provided as single LED packages, or multiple LEDs connected in series or parallel in one package. Presently, LED packages including one or more LEDs integrated together with some type of power conversion circuitry are not available. One significant barrier to the integration of LEDs and power conversion circuitry relates to the type and size of power management components needed to convert energy to the relatively lower voltage levels typically required to drive LEDs.

For example, voltage conversion apparatus (e.g., DC-to-DC converters) typically utilize inductors as energy storage elements, which cannot be effectively integrated in silicon chips to form integrated circuits. Inductor size is also a serious barrier to integrated circuit implementations, both in terms of an individual inductor component as part of any integrated circuit, as well as more specifically in LED packages. Furthermore, inductors typically cannot be made to be both efficient and handle a relatively wide range of voltages, and inductive converters generally require significant capacitance to store energy during converter operation. Thus, conventional voltage conversion apparatus based on inductors have a fairly significant footprint when compared with a single or multiple LED packages, and do not readily lend themselves to integration with LED packages.

Capacitive voltage conversion systems present similar challenges. Capacitive systems cannot convert voltage directly, and instead create fixed fractional multiplied or divided voltages. The number of capacitors required is directly related to the product of the integers in the numerator and denominator of the fraction. Since each capacitor also generally requires multiple switches to connect it between the higher voltage power source and a relatively lower voltage load, the number of components increases dramatically as the numerator and denominator increase, with a corresponding decrease in efficiency. If efficiency is a salient requirement, these systems must have practical ratios with a unity numerator or denominator; hence, either the input or output are low voltage at higher current, which effectively decreases efficiency. Thus, efficiency inevitably needs to be compromised at any particular operating voltage to decrease complexity and make simpler fractions.

Thus, there is a need in the art to provide appropriate voltage inputs to LEDs that overcomes at least the deficiencies of known techniques described above.

SUMMARY

An apparatus for controlling an LED system, the apparatus comprises a comparison circuit configured to compare at least one signal representative of a supply voltage with at least one other signal representative of a series voltage drop over at least some of a plurality of LEDs connected electrically in series. The apparatus comprises a controller, connected to the comparison circuit; and a power section connected to the controller. The power section is configured to operate at least one switch such that the number of LEDs operated in series may be changed in response to the comparison circuit.

An method of controlling an LED system comprising a plurality of LEDs comprises comparing at least one signal representative of a supply voltage with at least one other signal representative of a series voltage drop over at least some of a plurality of LEDs connected electrically in series. The method further comprises operating at least one switch to change the number of the plurality of LEDs operated in series in response to the comparing.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The term "digital control" as used herein refers to a circuit, microprocessor, programmable logic device (PLD), such as a field programmable gate array (FPGA) configured to determine a maximum number of series-connected LEDs that can be energized by an input voltage and to control available current paths to energize the determined number of series-connected LEDs. The digital control may be a state-machine comprising field-effect transistors (FETs), or may be a microprocessor instantiated in hardware or software or both, or may be a PLD, comprising, for example, software cores configured to determine and execute the logic to energize the determined LEDs.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Various embodiments of the present invention are described below, including certain embodiments relating particularly to LED-based light sources. It should be appreciated, however, that the present disclosure is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources. Begin by summarizing the problem discussed in the background and lead to the solution proposed by the inventors.

One impediment to widespread adoption of low-voltage LEDs and low-voltage LED-based lighting units as light sources in applications in which generally higher power supply voltages are readily available is the need to convert energy from one voltage to another, which, in many instances, results in conversion inefficiency and wasted energy. Furthermore, energy conversion typically involves power management components of a type and size that generally impede integration. Often LEDs are provided as single LED packages, or multiple LEDs connected in series or parallel in one package. LED packages of representative embodiments including one or more LEDs are beneficially integrated together with power conversion circuitry. The representative embodiments thus integrate LEDs and power conversion circuitry and foster power management components needed to energize the relatively lower voltage levels typically required to drive LEDs.

Figure 1:
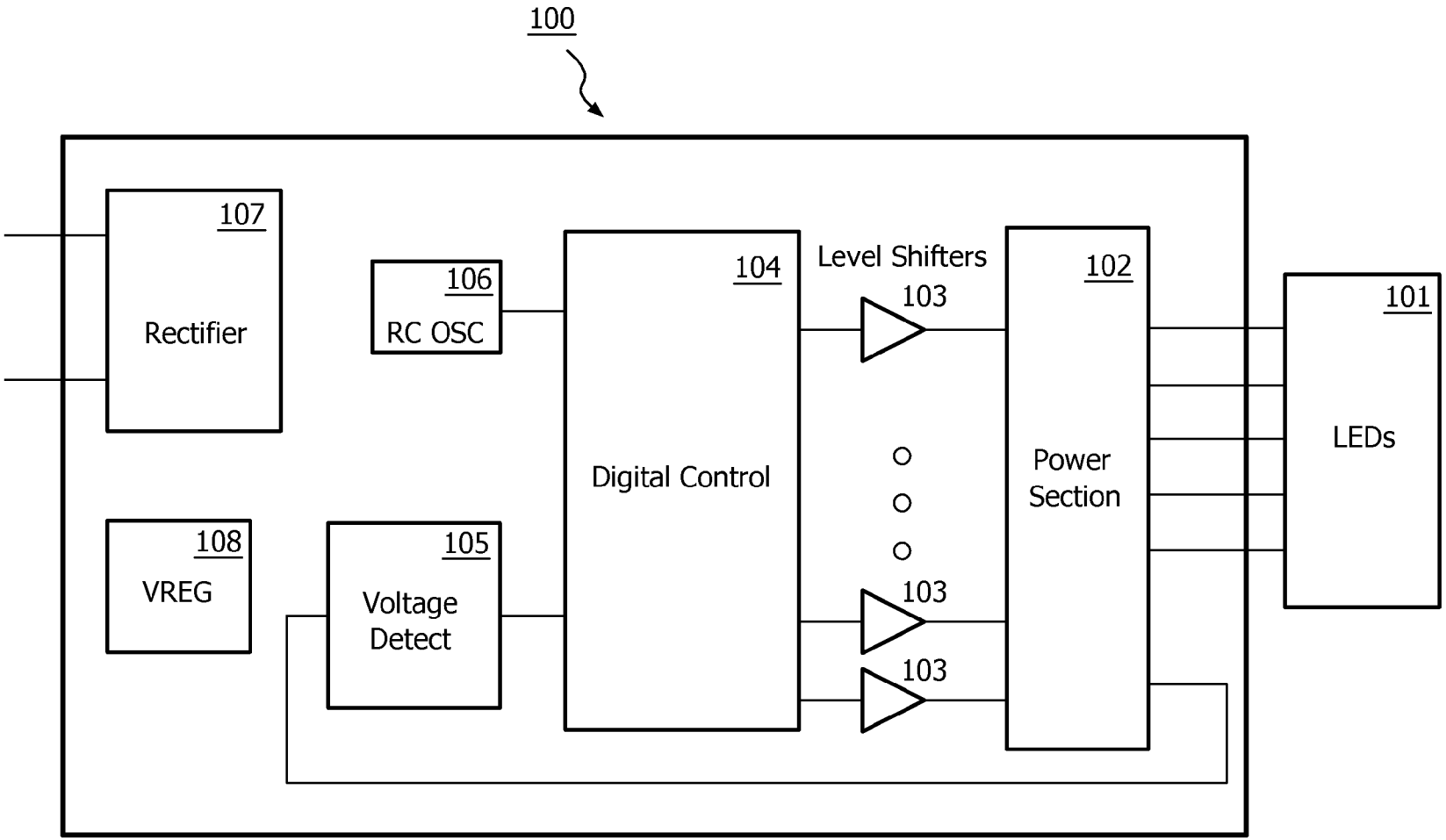
FIG. 1 illustrates a simplified block diagram of an apparatus in accordance with a representative embodiment.

Referring to FIG. 1, in one embodiment, an apparatus 100 for controlling series-connected LEDs of LED system 101 is shown in the form of a simplified block diagram. The apparatus 100 comprises a power section 102 connected between the LED system 101 and level shifters 103. The apparatus 100 comprises a digital control 104 connected to the level shifter 103. A voltage detector 105 is connected between the power section 102 and the digital control 104, and an oscillator 106, which is illustratively a radio frequency (RF) oscillator, is connected to the digital control to provide a timing signal to the digital control 104. The apparatus 100 also includes a rectifier 107 and a voltage regulator 108. Notably, the apparatus 100 may comprise discrete components useful in effecting the controlled energizing of the LEDs of the LED system 101, or may be instantiated as an integrated circuit, or may be a combination thereof. The LED system 101 is connected to the apparatus 100 as shown, and thus are separate from the apparatus. However, a fully integrated structure comprising the apparatus 100 and the LEDs in an integrated circuit is also contemplated. The integrated circuits for the apparatus 100, or the apparatus 100 and LED system 101 may be an application specific integrated circuit (ASIC). Component level integration of representative embodiments contemplates certain elements of the apparatus 100, to include the LED system 101, are integrated (e.g., as an ASIC), and others are discrete components of the apparatus 100 and LED system 101.

The LED system 101 illustratively comprises a plurality of LED-based lighting units can be arranged as a "light string," wherein each lighting unit constitutes an individually-controllable "node" of the light string. Applications suitable for such light strings include decorative and entertainment-oriented lighting applications (e.g., Christmas tree lights, display lights, theme park lighting, video and other game arcade lighting, etc.). One or more such light strings are configured to provide a variety of complex temporal and color-changing lighting effects. The nodes of a given light string are connected in a serial manner. The operating voltage required by each lighting unit (as well as the string, due to the parallel power interconnection of lighting units) typically is related to the forward voltage of the LEDs in each lighting unit (e.g., from approximately 2 V to approximately 3.5 V depending on the type/color of LED), the number of LEDs used for each "color channel" of the lighting unit and how they are interconnected, and how respective color channels are organized to receive power from a power source. Because the LEDs require a comparatively small voltage, in known apparatuses some type of voltage conversion device is desirable in order to provide a generally lower operating voltage to one or more LED-based lighting units from more commonly available higher power supply voltages (e.g., 12V DC, 15V DC, 24V DC, a rectified line voltage, etc.). In accordance with representative embodiments, rather than voltage conversion, the number of nodes is determined and, therefrom the voltage required in the series application.

In a representative embodiment, identical strings of one or more LEDs of the LED system 101 are configured to each be individually shorted. Control of the shorting devices requires knowledge of at least how many devices should be shorted. In accordance with representative embodiments, the number of devices to be shorted can be determined in several ways. One way is to measure the supply voltage, assuming a given voltage per LED or string, and explicitly calculate the number of LEDs or strings to energize therefrom. Alternatively, the present teachings contemplate a method which implicitly determines this information. The implicit information can be extracted by comparing the total available supply voltage, with the current LED string voltage. In a representative embodiment, the voltage detector determines the current LED string voltage. Since the number of LEDS currently operating in the string is known, this LED string voltage can be divided by this number N. The supply voltage from the rectifier 107 is known, and the digital controller 104 determines the number of LEDs that can be energized in series. For example, if the supply voltage divided by N+1 is greater than this number, then more LEDs may be operated, and the power section 103 is configured to short fewer LEDs or fewer groups of LEDs in the string of LED system 101. As a nominal example, if 3 of 4 possible LEDs are being operated and VLED/3<VSUPPLY/4 then an additional LED may be turned on.

Note that this division and comparison may conveniently be performed by tapped matched resistor strings, and voltage comparators, so no actual computation is needed. Furthermore, in systems where there are several operating modes, while the operating mode may be used to determine which resistor string or tap is used, it is also possible to simply build multiple comparison circuits, (utilizing traditional analog comparators), and ignore the outputs of those which do not correspond to the current mode. In other embodiments, the digital control may include a microprocessor instantiated with software to effect the calculation. In yet other embodiments, a PLD may be used to effect the calculation.

Figure 2:
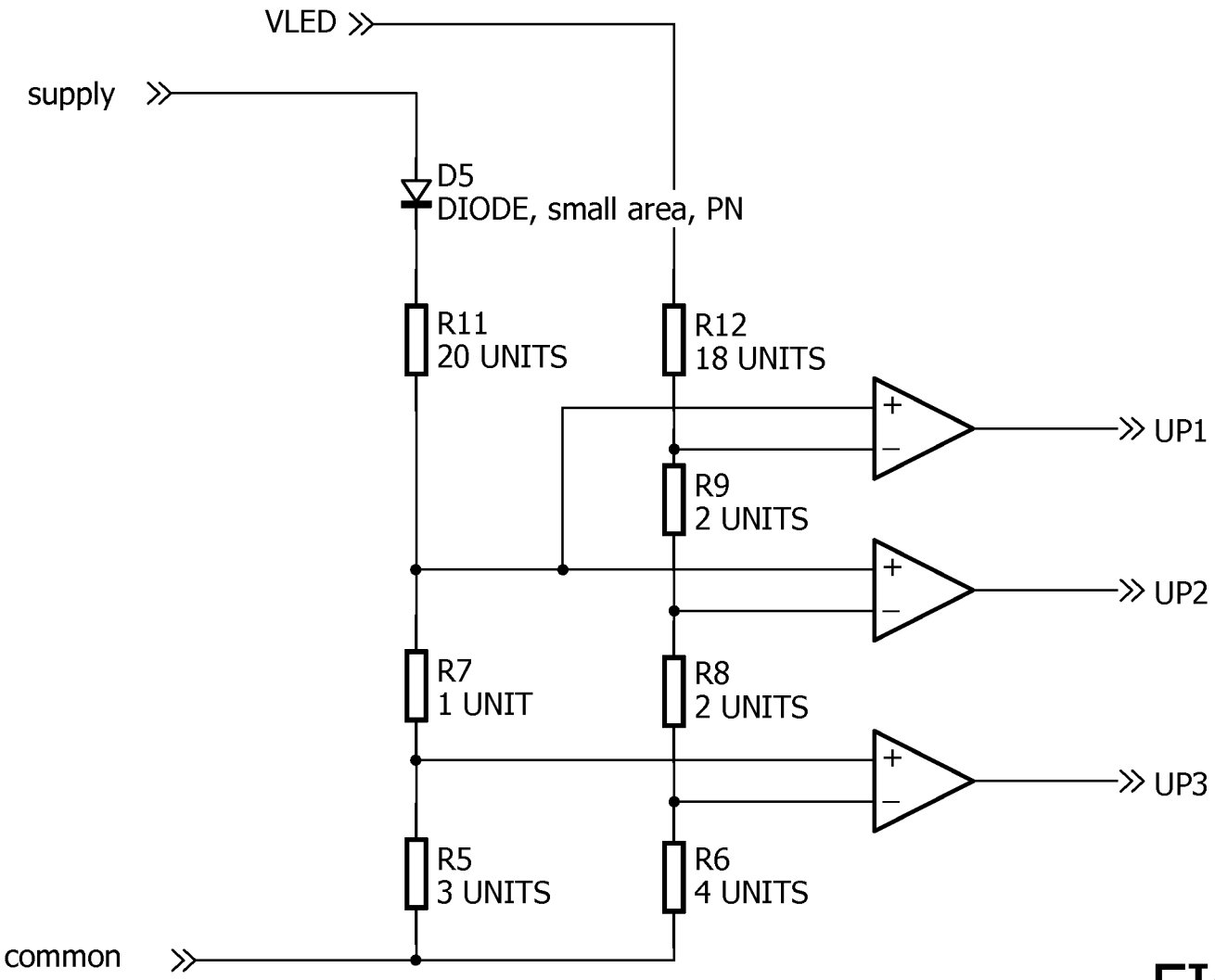
FIG. 2 illustrates a simplified power section schematic diagram, in accordance with a representative embodiment.

In operation, the voltage detector 105 provides a measure of the voltage across the LED system 101 to the digital control section 104. After determination of the number of strings that may be energized, the digital control section 104 provides an output to the level shifters 103 to control switches in the power section 102. Based on the input from the level shifters 103, the switches of the power section 102 short LEDs or LED strings of the LED system 101 so that the series voltage drop across the LEDs is close to, but less than the supply voltage. The power section may contain various power limiting components, to allow a desired current to flow through the LEDs. Further details are provided in the parent application referenced above, and a representative power section is shown in FIG. 2.

The calculation is considered implicit, because no explicit information is needed, i.e. the circuit determines the result of the comparison without any explicit knowledge of what the LED voltage is. Note that it is not always possible to determine if fewer LEDS should be operated from such an implicit comparison, without knowledge of the actual and desired current flow through the LEDS, as described in the parent application. FIG. 2 illustrates a simplified power section schematic diagram, in accordance with a representative embodiment. The resistor ladders may divide the input voltages by any multiple of the desired ratios, to further facilitate circuit design. For example if a 120V circuit were to be considered, with four shortable strings of LEDS as the LED system 101, then the voltage across any string of LEDs might be comparatively high. Alternatively, the comparators may function at a relatively low input voltage to foster more effective integration of the components, among other reasons. Thus while a comparison of LED/3 and the VSUPPLY/4 may be desired, all of the voltages may be divided by a factor (say 12) and compare LED/36 with VSUPPLY/48, which would result in much smaller voltages at the comparator. Note that if multiple comparator circuits are used for the different modes, then different divisors may be used as well. This can allow minimization of the effects of offset errors, while still allowing lower comparison voltages.

Normally other circuits such as the current limiting device 310 are present in the apparatus 100, and need to be operated as well, so the ratios may need to be adjusted to account for the extra necessary voltage. For example, if a dedicated current source requires 0.6 volts to operate, then the resistor values may be modified slightly so that the comparison is perturbed by the correct amount. Alternatively, one or more diodes or other active devices may be placed in series with at least one of the resistor strings to allow such perturbation. The shorting switches have some loss, and it may be useful to include or exclude their loss in the comparison. Note that the number of switches present may be dependent on the number of LEDs shorted, or if the number of LEDs shorted by different switches is itself different, then various switch settings may have different voltage losses. For example, if we assume that the shorting switches have a loss of 0.7V, and the comparison to be made is for the mode transition from 3 to 4 leds lit, and the current source has a loss of 0.6V, then we can compare (VLED−0.7)/3<(VSUPPLY−0.6)/4. In this case we might use a diode on each resistor string, or we might decide that since we know VLED/3 is approximately the voltage of a single LED (~3.3V), we can simply change the ratio by just a little bit, i.e. VLED/3.07<VSUPPLY/4. A combination of these techniques may also be used if convenient. It is intended that the designer may choose any combination of compensating elements or techniques, or that the designer may choose to ignore certain types of errors, or combine the effects of multiple known errors or losses into the overall resistor strings or circuits.

Note that some error is unavoidable in these types of calculations and comparisons. This is known and expected, and it may be desirable to further perturb the calculations to ensure that these errors always result in having more LEDS shorted, if it is desired to keep the circuit always functioning with the desired current flow; or alternatively to bias the circuit towards having fewer leds shorted, which will increase efficiency, but cause voltage levels where the supply voltage cannot support the desired current flow. If the circuit is to be used from a nominally DC source, then enforcing current flow would seem to be preferred, but if the circuit is intended for use with an AC source then either perturbation (or none) may be more desirable.

Figure 3:
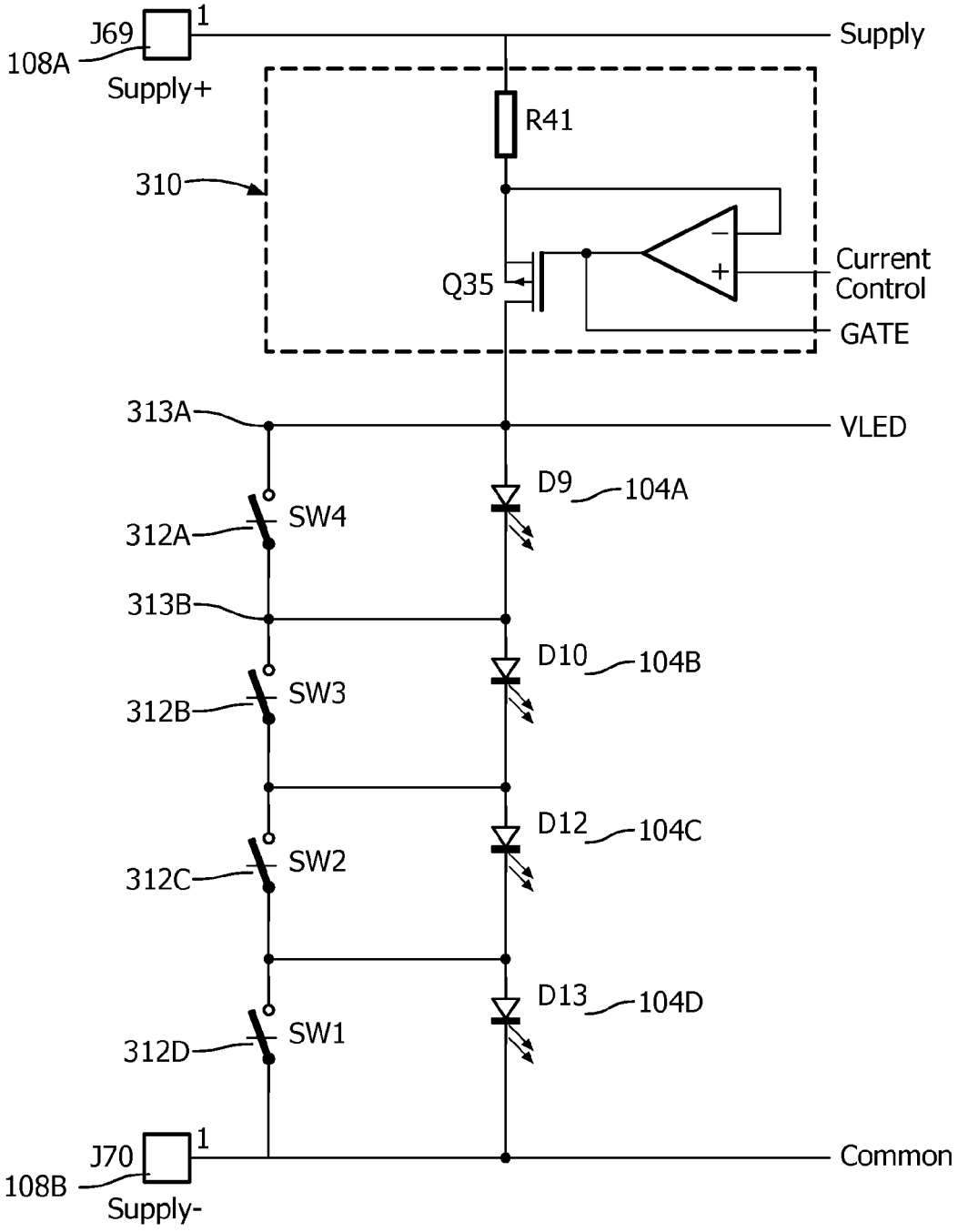
FIG. 3 illustrates a simplified schematic diagram of a voltage detector in accordance with a representative embodiment.

FIG. 3 illustrates a simplified schematic diagram of a voltage detector in accordance with a representative embodiment. The voltage detector shown in FIG. 3 is one example of a circuit 300 configured to perform the comparisons needed to determine the number of possible illuminating LEDs according to a representative embodiment. The voltage detector 105 may comprise the circuit 300 is intended to be illustrative and is not intended to exclude circuits, many of which may be different and more or less complicated. While the circuit shown in FIG. 2 can determine upward going mode transitions (towards more LEDs lit), downward mode transitions can be determined only when the LEDS are still energized, or must be determined by different circuits. In a representative embodiment, the current source can detect the loss of regulation through monitoring of the node marked "GATE", and this information can be used to effect downward mode transitions, as described in the parent application. In another representative embodiment, operating voltages of the LEDs 104*a*-104*d* can be stored and a comparison with the stored voltage can be made, even when the configured string of LEDs is no longer illuminated due to a reduction in supply voltage. This may be done in an analog fashion with capacitors, or with digital circuits, or possibly by using additional power circuitry to force one of the LEDs to always remain at least partially lit, and hence to obtain a measure of its forward voltage. Those skilled in the art will appreciate that there are a variety of circuits which may be employed.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An apparatus for controlling an LED system, the apparatus comprising:

a comparison circuit configured to compare at least one signal representative of a supply voltage with at least one other signal representative of a series voltage drop over at least some of a plurality of LEDs connected electrically in series;

a controller, connected to the comparison circuit and configured to determine a number of the plurality of LEDs that can be energized based on an input from the comparison circuit, wherein the input is based on the comparison of the representative signal of the supply voltage with the at least one other signal representative of the series voltage drop over at least some of the plurality of LEDs; and a power section connected to the controller, the power section being configured to operate at least one switch so that the number of LEDs determined by the controller is energized.

2. An apparatus as claimed in claim 1, wherein the apparatus comprises a single integrated circuit.

3. An apparatus as claimed in claim 2, wherein the LEDs are disposed over the single integrated circuit.

4. An apparatus as claimed in claim 1, wherein the apparatus comprises the LEDs in a package.

5. An apparatus as claimed in claim 4, wherein the package comprises a single package.

6. A method of controlling an LED system comprising a plurality of LEDs, the method comprising:

comparing at least one signal representative of a supply voltage with at least one other signal representative of a series voltage drop over at least some of a plurality of LEDs connected electrically in series;

determining a number of the plurality of LEDs that can be energized based on the comparing; and operating at least one switch so that the number of the plurality of LEDs is energized.

* * * * *